United States Patent [19]

De Rycke

[11] Patent Number: 4,830,949

[45] Date of Patent: May 16, 1989

[54] METHOD FOR PROCESSING A PHOTOGRAPHIC SILVER HALIDE EMULSION MATERIAL

[75] Inventor: Gino L. De Rycke, Mortsel, Belgium

[73] Assignee: AGFA-Gevaert N.V., Mortsel, Belgium

[21] Appl. No.: 187,918

[22] Filed: Apr. 29, 1988

[51] Int. Cl.[4] ..... G03C 5/54

[52] U.S. Cl. ..... 430/206; 430/203; 430/231; 430/251; 430/404; 430/428; 430/429

[58] Field of Search ..... 430/203, 206, 404, 251, 430/231, 428, 429

[56] References Cited

U.S. PATENT DOCUMENTS

| | | | |
|---|---|---|---|
| 2,740,717 | 4/1956 | Yutzy et al. | 430/206 |
| 3,179,517 | 4/1965 | Tregillus et al. | 430/206 |
| 3,647,464 | 3/1972 | Smith et al. | 430/206 |
| 4,775,614 | 10/1988 | De Rycke | 430/206 |

*Primary Examiner*—Richard L. Schilling
*Attorney, Agent, or Firm*—William J. Daniel

[57] ABSTRACT

An ecologically advantageous method for processing an exposed photographic silver halide emulsion layer-bearing material involves the steps of:

(A) developing in an aqueous alkaline liquid an image-wise exposed silver halide emulsion layer of said material by means of at least one diffusible developing agent in the absence of such an amount of silver halide solvent that would reduce the coverage of developed silver metal (Ag/m2) by more than 20%, (B) bringing the emulsion layer side of said developed photographic material while still wet by the liquid from step (A) into contact with a water-absorbing processing layer of a receptor element that contains in an organic hydrophilic colloid binder a silver halide reducing agent and silver halide complexing agent and in waterpermeable relationship therewith physical development nuclei, (C) maintaining said photographic material and receptor compound into said receptor element until removal of undeveloped silver halide from the exposed silver halide emulsion layer is substantially completed, and (D) separating the photographic material from the receptor element, said element containing said development nuclei at a coverage in the range of from 0.05 g/m2 to 2 g/m2, and said silver complexing agent at a coverage per m2 corresponding with at least 5 mole % of the molar coverage per m2 of silver halide in the photographic material to be processed.

17 Claims, No Drawings

METHOD FOR PROCESSING A PHOTOGRAPHIC SILVER HALIDE EMULSION MATERIAL

DESCRIPTION

The present invention relates to a method and material for the rapid and ecologically clean processing of a photographic silver halide emulsion element wherein the undeveloped silver halide from a photographic element is removed using a particularly small amount of liquid provided by an absorbing element containing a silver ion complexing agent, reducing agent and inorganic nuclei catalysing the reduction of silver ions to silver.

Silver halide emulsion materials with all their enormous advantages in sensitivity, spectral sensitisation and capability of producing black-and-white and colour images with strong optical density and high resolving power have the drawback of requiring in conventional processing several processing liquids and a time consuming drying for the final image. Particularly the fixing and rinsing steps are of relatively long duration when archival image quality is desired. Moreover, exhausted fixing liquids and even wash liquids containing dissolved silver pose an ecological problem because silver ions only in a very limited quantity may be drained off into the sewer. Further, silver recovery from fixing liquids in large scale processing is nowadays a must for its economic importance and proceeds by the deposition of dissolved silver as metal or silver precipitate from the fixing liquid bulk.

Motivated by these specific drawbacks and requirements associated with the conventional processing of photographic silver halide emulsion materials, there has been a constant search for a rapid ecologically clean processing which is dry as possible and offering archival high quality images.

In a successful rapid access processing known as diffusion transfer reversal (DTR-) processing, an exposed silver halide emulsion material is developed and non-developed silver halide is complexed and transferred by diffusion into an image-receiving material to form therein a reversal silver image by reduction with the aid of a developing agent in the presence of minute amounts of so-called development nuclei.

Such development nuclei include e.g. colloidal heavy metal sulphides such as silver sulphide, nickel sulphide, mercury sulphide, palladium sulphide and other heavy metal sulphides [ref. e. g. Photographic Silver Halide Diffusion Processes by Andre Rott and Edith Weyde—Focal Press—London and New York (1972) p. 48–49] and act as a catalyst in minor amounts for silver metal deposition in the redox reaction wherein a reducing agent (silver halide developing agent) reacts with the complexed silver halide decomposing it to deposit free silver metal on said nuclei. This metal deposition is also known under the wording "physical development".

Many efforts and research have been devoted to obtain diffusion transfer images of high quality in the image receiving material with reduced amount of silver halide in the light-sensitive material as compared with the conventional processing. These efforts and research directed to a large choice of development nuclei, black-toning agents, binding agents, etc., led for many purposes to satisfactory image quality in the image receiving material. In some fields of image reproduction, e.g. the graphic art field, however, where in some applications particular sharpness, high resolving power or other extreme sensitometric qualities are required conventional processing, i.e. image formation not based on diffusion transfer of image forming substances, is still preferred.

In U.S. Pat. Nos. 3,179,517 and 3,647,464 a process for developing and fixing a photographic silver halide emulsion material with a minimum of processing liquid in combination with a processing web comprising silver ion precipitating agents is described. As described in U.S. Pat. No. 3,179,517 (col. 6) although the silver ion precipitating agents are chemically the same as those used in diffusion transfer reversal processing (DTR) they are used for silver ion precipitation in a much larger coverage per m2, e.g. from 30 to 1200 mg compared with 5 to 20 mg per m2 in DTR.

The developing of an image-wise exposed photographic silver halide emulsion material proceeds together with its fixing by using a processing liquid comprising an alkaline solution of one or more developing agents and a silver halide solvent (fixing agent). The processing web described in U.S. Pat. No. 3,647,464 may also be employed to process silver salt-sensitized emulsion layers containing incorporated developing agent. In this embodiment the silver halide developing agent is omitted from the processing solution since it is already present in the emulsion layer. By the fact, however, that developing agent(s) and silver halide solvent are both present simultaneously in the processing step a rather large portion of exposed but still not developed silver halide will be removed giving rise to loss of fine image details and a drop in maximum optical density.

According to published European Patent Application (EP-A) No. 0 221 599 there is provided a method for fixing an image in an exposed and developed silver halide emulsion layer of a photographic material which method comprises the steps:

(A) bringing an exposed and developed photographic material while being wet with its silver halide emulsion layer side in intimate contact with a water-absorbing layer of a processing element, preferably sheet or web, that contains in an organic hydrophilic colloid binder a silver halide complexing agent, also called silver halide solvent, and in dispersed form a metal sulphide as silver ion scavenging agent, (B) maintaining said photographic material and processing element in contact until the transfer of dissolved complexed silver compound into said processing element is substantially complete, and (C) separating the photographic material from the processing element, and wherein said water-absorbent layer contains said metal sulphide in colloidal form with an average grain size below 0.1 $\mu$m, and contains said metal sulphide at a sulphide ion coverage per m2 at least stoichiometrically equivalent with the silver ion coverage per m2 in the photographic material in unexposed and undeveloped state, the molar coverage per m2 of said complexing agent being not lower than a 20th of the molar coverage per m2 of silver halide in the photographic material to be processed.

According to an embodiment of said method for particularly rapid removal of the undeveloped silver halide from the exposed photographic material, the sulphide coverage per m2 is at least 50% in excess over the stoichiometric amount corresponding with the silver halide coverage per m2 in the undeveloped silver halide emulsion material.

According to a preferred embodiment of the above method complexed silver that has been transferred into the receptor element is converted therein by colloidal zinc sulphide into a silver sulphide precipitate having a very low solubility product. In the conversion reaction zinc ions are set free from the colloidal zinc sulphide acting as silver ion scavenging agent. The zinc ions for the greater part remain in the receptor element which acts as a kind of sponge. This approach is particularly interesting from the viewpoint of ecology in that there is no waste water left containing silver and zinc ions in concentrations surpassing official standards.

The conversion reaction operating with fairly large amounts of sulphide ions, e.g. delivered by zinc sulphide, proceeds much faster, especially at the start, than the redox reaction that proceeds in the presence of small amounts of metal sulphide acting as physical development nuclei.

The presence of silver sulphide at the end of the conversion reaction in conjunction with rather large amounts of other heavy metal ions e.g. zinc ions makes silver recovery less convenient.

It is an object of the present invention to provide a method for a rapid and ecologically clean processing of an exposed photographic silver halide emulsion material with the aid of a particular receptor element using a fairly small amount of liquid and yielding images of high quality without long duration drying.

It is an other object of the present invention to provide a stable processing element for use in said method and wherefrom silver can be easily recovered without having to be separated from substantial amounts of other metals.

Other objects and advantages of the present invention will appear from the further description.

SUMMARY OF THE INVENTION

According to the present invention there is provided a method for processing an exposed photographic silver halide emulsion layer-bearing material which method comprises the steps of:

(A) developing an image-wise exposed silver halide emulsion layer of said material by means of at least one diffusible developing agent in the absence of such an amount of silver halide solvent that would reduce the coverage of developed silver metal (Ag/m2) by more than 20%, using an aqueous alkaline liquid having preferably a pH of at least 9, more preferably of at least 11, (B) bringing the emulsion layer side of the developed photographic material while still wet by the liquid from step (A) into contact with a water-absorbing processing layer of a receptor element, also called processing element, that contains in an organic hydrophilic colloid binder a silver halide reducing agent and silver halide complexing agent, also called silver halide solvent, and in waterpermeable relationship therewith physical development nuclei, (C) maintaining said photographic material and receptor element in contact to allow the transfer of dissolved complexed silver compound into said receptor element until removal of undeveloped silver halide from the exposed silver halide emulsion layer is substantially completed, and (D) separating the photographic material from the receptor element, and wherein said element contains said development nuclei at a coverage in the range from 0.05 g/m2 to 2 g/m2, and said silver complexing agent at a coverage per m2 corresponding with at least 5 mole % of the molar coverage per m2 of silver halide in the photographic material to be processed.

DETAILED DESCRIPTION OF THE INVENTION

The receptor element contains said silver halide reducing agent, being preferably a developing agent capable of reducing photo-exposed silver halide, in a preferred coverage in the range from 0.2 to 3 g/m2.

Useful physical development nuclei are e.g. heavy metal sulphides or selenides in the colloidal state, wherein by heavy metal is meant a metal with an atomic number of at least 24. A particularly useful colloidal metal sulphide is silver sulphide. Other useful colloidal heavy metal sulphides are selected from the group of sulphides of copper, tin, gold, mercury, platinum, lead, cadmium, nickel, palladium, antimony, bismuth and zinc.

A preferred combination of heavy metal sulphides consists of a mixture of colloidal silver sulphide and colloidal zinc sulphide wherein the zinc sulphide at least partially acts in a conversion reaction with silver ions provided by complexed silver halide forming therewith a silver sulphide precipitate.

In a preferred embodiment for avoiding loss of developable silver halide in the still developing silver halide emulsion material, developing step (A) is carried out in the complete absence of silver halide solvent.

The colloidal state relates to an average particle size not larger than 0.1 μm including conglomerates of particles having that size.

Fog formation by deposition of colloidal silver in the photographic material is substantially avoided by contacting the still wet developed photographic material with an initially dry receptor element.

Normally a quantity of developer liquid in the range from 20 to 60 ml per m2 is absorbed by the photographic material. The processing layer acting as a kind of sponge makes it possible to obtain very rapidly almost dry photographic copies after completing the transfer of the undeveloped complexed silver halide and fixing thereof in said processing element as silver metal.

Preferred siver halide developing agents for use according to the present invention in the receptor element are hydroquinone type developing agents optionally used in conjunction with auxiliary developing agents, e.g. 3-pyrazolidinone type developing agents.

A preferred processing element, e.g. sheet or web, for use according to the present invention contains on a support a water-absorbing processing layer comprising a hydrophilic organic colloid as binding agent, colloidal silver sulphide at a coverage in the range from 0.05 g/m2 to 2 g/m2, a silver complexing agent at a coverage per m2 corresponding with at least 5 mole % of the molar coverage per m2 of silver halide in the photographic material to be processed, and a silver halide developing agent in a coverage in the range from 0.2 to 3 g/m2.

The above processing element may be used advantageously for the complete fixing of silver halide emulsion materials having a silver halide coverage in a range corresponding with 1.7 g to 8.5 g of silver nitrate per m2.

In order to avoid as much as possible the soiling of the exposed and developed photographic silver halide emulsion material with oxidized developing agent originating from the receptor sheet, the developing agent incorporated in the receptor sheet is of the diffusion resistant type. Examples of such developing agents are described in U.S. Pat. No. 2,740,717, e.g. 3,4-dihydroxy diphenyl and diffusion resistant hydroquinones, e.g. 2'-5'-bis(5-n-hexyloxycarbonyl-2-methyl-pent-yl)-hydroquinone called hereinafter diffusion resistant developing agent A, prepared as described in European Pat. No. 0069068.

Any known silver halide solvent may be used in the process of the present invention, e.g. thiocyanates but preferably thiosulphates. The best results are obtained with sodium thiosulphate. The coverage of a thiosulphate in the processing element is preferably in the range from 0.50 to 5 g per m2.

These relatively small amounts of said silver halide solvent are sufficient since the latter is regained in the precipitation of the complexed silver as silver metal and silver sulphide and will be used in complexing again and again till complete extraction of the silver halide from the silver halide emulsion layer.

In a particular embodiment the silver halide solvent and/or developing agent is (are) used in a layer different from a waterpermeable layer containing the metal sulphides but in water-permeable relationship therewith, e.g. in a waterpermeable subcoat containing a hydrophilic colloid binder and having a thickness in the range from e.g. 10 μm to 100 μm.

The preparation of the metal sulphides used according to the present invention in colloidal state proceeds e.g. in aqueous medium by mixing a solution of a corresponding water-soluble metal salt with hydrogen sulphide or a solution of a water-soluble ammonium or alkali metal sulphide. The colloidal product formed by said mixing is freed, e.g. by washing, from residual salt so that no excess of free sulphide and salt formed in the reaction is present. During the precipitation of the colloidal poorly water-soluble metal sulphide optionally a hydrophilic colloid, e.g. colloidal silica, may be present.

In a water-absorbing layer of the processing element used according to the present invention any of the hydrophilic colloids known from photographic silver halide emulsion materials may be used. Examples of useful hydrophilic colloid binding agents are: gelatin, polyvinyl alcohol, polyvinyl pyrrolidinone, polyacrylamide, methyl cellulose, carboxymethyl cellulose and carragenates.

Other ingredients that may be present in any water-absorbing layer, e.g. for reducing stickiness, are polymers applied from an aqueous polymer dispersion, i.e. latex. For that purpose polymethyl methacrylate latex is particularly useful.

The thickness of the water-absorbing layer containing the silver complexing agent is e.g. from 1 μm 100 μm preferably in the range from 2 μm to 20 μm. The organic hydrophilic colloid binder is preferably present in the range of 1 to 4 g per m2.

The hydrophilic colloid binding agent may be used in admixture with dextrin and/or colloidal silica (silica gel) which allows a faster diffusion of complexed silver halide than gelatin.

The water-absorbing layer(s) of the processing element are applied preferably on a flexible support. Particularly suited supports are paper supports and resin supports of the type known in photographic silver halide emulsion materials.

The present process offers a particularly rapid access to the fixed photographic print when the exposed photographic material contains already the necessary developing agent(s) and the processing is carried out with an aqueous alkaline liquid, called activator liquid, having preferably a pH of at least 9, more preferably of at least 11.

In a particular embodiment the silver halide emulsion materials contain the necessary developing agent in combination with a base generating or base releasing agent, hereby the alkalinity of the aqueous liquid used in step (A) can be obtained in situ from substances incorporated in the photographic material itself.

According to one embodiment a base generating system is used wherein a photographic silver halide emulsion material contains as described e.g. in U.S. Pat. No. 3,260,598 and in published European Patent Application No. 0 210 659 a slightly soluble metal compound such as zinc oxide and in an aqueous processing liquid a substance that by reaction with said compound yields hydroxyl ions. Such a substance is e.g. sodium picolinate acting as complexing agent for zinc ions. Using such base generating system the aqueous processing liquid on contact with said photographic material becomes alkaline in situ in step (A).

According to another embodiment a thermally activated base generating compound is used in the photographic material which after its image-wise exposure is heated for releasing a free base so that the liquid treatment of the photographic material in step (A) initially starts with plain water to effect development in the presence of a base released in the photographic material. Typical base-releasing agents for use in such photographic materials are described in GB-P No. 998,949 and in DE-OS No. 3,529,934.

It has been found experimentally that the treatment of the just developed photographic material with an acid stop bath or neutral rinsing liquid tends to retard access to the final image-carrying material not only because such treatment takes time but also because the lowering of the pH in the photographic material and receptor element slows down the speed of the reduction of the silver complex compounds and the formation of silver sulphide.

By the presence of swellable hydrophilic colloidal substances in the receptor sheet or web it obtains sufficient liquid absorption power to act as a sponge so that the photographic material after its separation is left substantially dry, certainly when the contacting step proceeds at elevated temperature. The consequential elimination or at least significant; shortening of a drying step is a real advantage in terms of rapid access and energy saving.

The aqueous liquid used for carrying out the development of the photographic material may be applied in any way known to those skilled in the art, e.g. by dipping or spraying.

According to a preferred embodiment the liquid used in the development is applied by meniscus coating in a tray device and the photographic material is led through conveying rollers whereby it is possible to apply only very small amounts of liquid, e.g. in the range of 20 to 60 ml per m2 that are consumed almost completely so that at most only a minor amount of processing liquid is returned into the liquid container so that development takes place always with fresh processing liquid and no waste liquid is left or formed.

According to a particular embodiment applied in instant photography the developing liquid is made available in a liquid container, a so-called "pod" associated with the photographic silver halide emulsion material (see Neblette's Handbook of Photography and Reprography, 7th ed. Edited by John M. Sturge (1977) p. 282-285). Other techniques for providing processing liquid in situ in a photographic silver halide emulsion material operate with micro-capsules that are pressure and/or heat-senstive. Examples of such micro-capsules, their preparation and use are described in GB-P Nos. 1,034,437 and 1,298,194. In another technique applied for almost dry processing use is made of photographic materials incorporating the photographic processing substances in so-called thermosolvents that are substances solid at room temperature but exhibit wetting capacity when melting by heating the photographic material. Examples of thermosolvents and their use are described in U.S. Pat. No. 3,438,776.

The transfer of complexed silver and its physical development are speeded up by increase of the temperature. So, for a particularly rapid transfer of the silver complex compounds and silver ion scavenging in the processing web or sheet, the processing proceeds e.g. in the range of 30° to 90° C. In that temperature range the use of a non-softenable binder such as colloidal silica is preferred because it withstands these temperatures without causing sticking of the processing web or sheet layer. The heating can be carried out by bringing the photographic material contacting the processing sheet or web between heated plates or rollers or by irradiation with infra-red light or any other heating technique used in the art.

A final wash (rinsing) of the silver halide emulsion material after its contact with the present processing element, e.g. sheet or web, is not strictly necessary but may be beneficial if for some or other reason residual stain, e.g. due to residual developing agent has to be removed.

The process of the present invention can be applied in conjunction with any type of silver halide, e.g. silver chloride, silver bromide, silver chlorobromide, silver bromide-iodide or mixtures thereof. A survey of silver halide emulsion preparation, addenda and processing is given e.g. in Research Disclosure December 1978, item 17643 titled "Photographic silver halide emulsions, preparation, addenda, processing and systems".

The present invention is very advantageously applied for the fixing of lith-type emulsion materials which mainly contain silver chloride since silver chloride has the highest solubility in silver halide solvents.

Silver chloride emulsions having a silver chloride coverage corresponding with an amount equivalent to 3 g of silver nitrate per m2 can according to the present invention be freed from silver chloride in less than 30 s by contact with said sheet or web at 50° C.

Photographic materials in the form of a sheet are preferably fixed in contact with receptor materials in sheet form, e.g. by conveying them in contact between pressure rollers as are present in classical diffusion transfer reversal apparatus some types of which are described in "Photographic Silver Halide Diffusion Processes" by Andre Rott and Edith Weyde, Focal Press—London—New York (1972) p. 242-256.

Photographic materials in the form of a strip or ribbon, e.g. microfilm, are processed advantageously by contacting with a processing web supplied from different spools and delivered between two parallel plates exerting some pressure to the contacting materials. By coating the plates with polytetrafluoroethylene or by a polishing treatment their friction is kept low enough to allow a smooth passage of the contacting materials between the plates. In connection herewith the attention is drawn to an apparatus suitable for web processing of pre-wetted photographic material and DTR-receptor material described in the already mentioned Neblette's Handbook of Photography and Reprography, p. 253-254 under the trade name DITRICON of HRB-Singer.

According to a practical embodiment a receptor web of the present invention is supplied from a spool in dry state and brought together with a still wet developed photographic material in web form on another spool for the accomplishment of the transfer of the dissolved silver halide and scavenging of its silver ions in the web. Thereupon the web is peeled apart from the film and web and film are wound on separate spools. The film is optionally rinsed and dried before storage. An arrangement for rapid film or web processing is illustrated in the already mentioned book of Andre Rott and Edith Weyde, p. 156.

To obtain a very rapid moistening the surface of the processing web or sheet may be coated with or contain a wetting agents. Examples of particularly useful wetting agents are fluoroalkyl wetting agents, e.g. of the type described in Belgian Patent Specification No. 742,680 and the anionic wetting agents described in EP No. 0 014 008.

According to a special embodiment the present processing web or sheet is adapted for the production of a "retained image" by a dye diffusion transfer process. For improving the dye transfer the processing sheet or web used according to the present invention contains also a mordanting agent for fixing the transferred dye.

Several embodiments of the dye diffusion transfer process are described by Christian C. Van de Sande in Angew. Chem. Int. Ed. Engl. 22 (1983) 191-209. The terminology "retained image" is used e.g. in Research Disclosure (No. 17362) of December 1978 and relates to a dye diffusion transfer process wherein the image left (retained) in the photographic dye diffusion transfer material after image-wise removal of mobile or mobilized dye is used as the final photographic product containing a silver image and dye image(s) in superposition. Such gives a considerable economy in silver comsumption since optical density is built up both by dye and silver metal.

When anionic dyes have to be mordanted the water-absorbing layer used in the present receptor sheet or web contains cationic polymeric mordants as described e.g. in U.S. Pat. No. 4,186,014, wherein a particularly useful mordanting agent prepared from 4,4'-diphenylmethane diisocyanate and N-ethyldiethanolamine quaternized with epichlorohydrine is described. Other useful mordanting agents are described in U.S. Pat. No. 2,882,156, 2,484,430 and 3,271,147. The coverage of the mordanting agent is e.g. in the range from 0.1 to 5.0 g per m2. The mordanting agent when itself having binding properties may play the role of hydrophilic colloid binding agent in the processing sheet or web according to the present invention.

According to a particular embodiment of the processing element, a mordanting agent is used to remove from the photographic material not only an ionic dye as is the case in retained dye image production by a dye diffusion transfer process but likewise any other residual ionic chemical, e.g. ionic residual oxidized or unoxidized developing agent, e.g. hydroquinone monosulphonate, spectral sensitizing dyes and/or filtering dyes to obtain a more white or cleaner image background. Such may be of interest in the processing of double side coated radiographic materials that contain such dyes for lowering the cross-over as described e.g. in U.S. Pat. No. 4,130,428.

The following examples illustrate the present invention without, however, limiting it thereto. All ratios, percentages and parts are by weight unless otherwise stated.

EXAMPLE 1

Preparation of silver sulphide nuclei dispersion

Preparation of the starting solutions.

Solution A 5 g of gelatin were swollen in 470 ml of demineralized water at room temperature and thereupon brought into solution by heating at 45° C.

Thereto 25.5 ml of an aqueous 2.96 N solution of silver nitrate was added while stirring.

Solution B 75.5 g of gelatin were swollen in 952 ml of demineralized water at room temperature and thereupon brough into solution by heating at 45° C.

Thereto 130 ml of a 10% aqueous solution of $Na_2S_2O_3.5H_2O$ were added while stirring.

Solution A and solution B were mixed vigorously with a high speed mixer. After a mixing time of 3 minutes 0.3 ml of benzylalcohol were added and thereupon the temperature of the mixture was raised to 45° C. while stirring slowly.

The obtained mixture containing colloidal silver sulphide was put on ice to set.

The gelled mass was noodled and washed with demineralized water to remove residual water-soluble compounds.

By heating the gel to 40° C. a stable dispersion containing 4.9% of gelatin and 0.55% of silver sulphide was obtained.

Preparation of receptor sheet

A coating composition was made by mixing the following ingredients:

| | |
|---|---|
| silver sulphide dispersion (prepared as described above) | 100 g |
| sodium thiosulphate | 1.50 g |
| sodium sulphite | 1.00 g |
| sodium bromide | 0.50 g |
| hydroquinone | 0.35 g |
| demineralized water | 20 ml |
| 20% aqueous solution of dextran (average molecular weight: 70,000 | 2 ml |
| 1.4% aqueous solution of 7-ethyl-2-methyl-4-undecanol-H sulphate sodium salt as wetting agent | 1 ml |

The coating composition was applied on a subbed polyethylene terephthalate support at a wet coating thickness of 110 μm.

| The dried receptor layer contained per m2: | |
|---|---|
| colloidal silver sulphide | 0.46 g |
| sodium thiosulphate | 1.30 g |
| sodium sulphite | 0.85 g |
| sodium bromide | 0.43 g |
| hydroquinone | 0.30 g |
| dextran | 0.34 g |
| gelatin | 4.20 g |

Fixing processing

A photographic paper material for use in phototype setting containing a gelatin - silver halide emulsion layer incorporating silver chloro-bromide-iodide grains (AgCl : 97.9 mole %, AgBr : 1.8 mole % and AgI : 0.3 mole %) at a coverage of silver halide equivalent with 2.50 g of silver nitrate per m2 and having an average grain size of 0.42 μm and a gelatin to silver halide ratio of 1 (the silver halide being expressed as an equivalent amount of silver nitrate) and including as developing agent hydroquinone at a coverage of 0.30 g per m2 was provided.

A strip of said photographic paper material being in half of its surface area exposed through a step wedge was treated at 20° C. for 5 s with an alkaline activator solution having the following composition:

| | |
|---|---|
| NaOH | 30 g |
| $Na_2SO_3$ | 50 g |
| NaBr | 2 g |
| ethylene diamine tetra-acetic acid Na-salt | 1.5 g |
| hydroxyethylcellulose | 2.5 g |
| 1.4% aqueous solution of 7-ethyl-2-methyl-4-undecanol-H sulphate sodium salt as wetting agent | 1 ml |
| distilled water up to | 1000 ml |
| | pH: 13.5 |

The still wet photographic material was put with its emulsion layer side into contact with the above receptor sheet and pressed in contact therewith at 20° C. for 1 min in a diffusion transfer processing apparatus COPYPROOF CP 38 (COPYPROOF is a trade name of Agfa-Gevaert N.V. Belgium), which apparatus was modified in such a way that the receptor sheet did not enter the tray containing the alkaline activator solution.

In said apparatus the photographic material wetted with said activator solution was pressed against the dry receptor sheet and after contact therewith the photographic material was led between a pair of hardrubber rollers removing still adhering liquid by quetsching.

In the non-exposed area of the thus treated photographic material only an amount of silver equivalent with a coverage of 0.04 g $AgNO_3$/m2 was left after rinsing for 15 s in running water at 20° C.

EXAMPLE 2

Preparation of silver sulphide nuclei dispersion

The preparation proceeded as described in Example 1.

Preparation of colloidal zinc sulphide

In a 5 l beaker were put 300 g of $Na_2S.9\ H_2O$ in 1000 ml of distilled water. While vigourously stirring a solution of 400 g of $ZnSO_4.7\ H_2O$ in 1000 ml of distilled water were added to the sodium sulphide solution. After the addition stirring was continued for 10 min at room temperature (20° C.).

The formed colloidal precipitate was separated by filtering on a paper filter and washed on that filter with 1 l of distilled water. Thereupon washing was completed by mixing the precipitate with 2 l of distilled water and filtering again. The colloidal ZnS having an average grain size of 5 nm was kept in the form of a dispersion (slurry) containing 14 g of ZnS per 100 g. Yield of colloidal ZnS: 120 g.

The colloidal zinc sulphide was introduced into an aqueous gelatin solution to obtain a colloidal dispersion containing 3.1% of zinc sulphide and 5.4% of gelatin.

Preparation of receptor sheet

A coating composition was made by thoroughly mixing the following ingredients:

| | |
|---|---|
| colloidal silver sulphide dispersion | 90 g |
| colloidal zinc sulphide dispersion | 10 g |
| sodium thiosulphate | 1.50 g |
| sodium sulphite | 0.50 g |
| sodium bromide | 0.50 g |
| hydroquinone | 0.35 g |
| demineralized water | 20 ml |
| 20% aqueous solution of dextran (average molecular weight 70,000) | 2 ml |
| 1.4% aqueous solution of 7-ethyl-2-methyl-4-undecanol-H sulphate sodium salt as wetting agent | 1 ml |

The coating composition was applied on a subbed polyethylene terephthalate support at a wet coating thickness of 110 μm.

| The dried receptor layer contained per m2: | |
|---|---|
| colloidal silver sulphide | 0.41 g |
| colloidal zinc sulphide | 0.26 g |
| sodium thiosulphate | 1.30 g |
| sodium sulphite | 0.43 g |
| sodium bromide | 0.43 g |
| hydroquinone | 0.30 g |
| dextran | 0.34 g |
| gelatin | 4.30 g |

Fixing processing

A photographic phototype setting material as described in Example 1 was processed as described therein with the difference however, that the above prepared receptor sheet was used.

In the non-exposed area of the thus treated photographic material an amount of silver equivalent with a coverage of 0.05 g of $AgNO_3$/m2 was left, no rinsing being applied.

EXAMPLE 3

Preparation of silver sulphide nuclei dispersion

The preparation proceeded as described in Example 1.

Preparation of receptor sheet

A coating composition was made by mixing the following ingredients:

| | |
|---|---|
| colloidal silver sulphide dispersion | 70 g |
| 4.8% aqueous dispersion of diffusion resistant developing agent A | 30 g |
| sodium thiosulphate | 1.50 g |
| sodium sulphite | 0.50 g |
| sodium bromide | 0.50 g |
| demineralized water | 20 ml |
| 20% aqueous solution of dextran (average molecular weight 70,000) | 2 ml |
| 1.4% aqueous solution of 7-ethyl-2-methyl-4-undecanol-H sulphate sodium salt as wetting agent | 1 ml |

The coating composition was applied on a subbed polyethylene terephthalate support at a wet coating thickness of 130 μm.

| The dried receptor layer contained per m2: | |
|---|---|
| colloidal silver sulphide | 0.38 g |
| diffusion resistant developing agent A | 1.44 g |
| sodium thiosulphate | 1.50 g |
| sodium sulphite | 0.50 g |
| sodium bromide | 0.50 g |
| dextran | 0.40 g |
| gelatin | 4.90 g |

Fixing processing

A photographic phototype setting material as described in Example 1 was processed as described therein but using the above prepared receptor sheet.

In the non-exposed area of the thus treated photographic material an amount of silver equivalent with a coverage of 0.05 g of $AgNO_3$/m2 was left after rinsing for 15 s in running water at 20° C.

EXAMPLE 4

Example 1 was repeated with the difference that a microfilm material was processed.

The microfilm material contained a gelatin-silver halide emulsion layer incorporating silver bromide-chloride grains (AgBr : 99 mole % and AgCl : 1 mole %) being applied at a coverage of silver halide equivalent with 2.10 g of silver nitrate per m2 and having an average grain size of 0.30 μm and a gelatin to silver halide ratio of 1 (the silver halide being expressed as an equivalent amount of silver nitrate) and included as developing agent hydroquinone at a coverage of 0.20 g per m2.

A strip of said microfilm material in half of its surface area was exposed through a step wedge and treated at 20° C. for 5 s with an alkaline activator solution as described in Example 1.

While being still wet by the activator solution the microfilm material was contacted for 1 minute at 20° C. with the receptor material of Example 1. After separation an amount of silver equivalent with 0.02 g of silver nitrate per m2 was left in the unexposed areas of the microfilm material which was rinsed in running water for 15 s at 20° C.

EXAMPLES 5–8

Example 4 was repeated with the difference however, that receptor sheets were used wherein the colloidal silver sulphide was replaced respectively by same molar amounts of colloidal lead sulphide, cooper sulphide and Bi(III) sulphide.

The contact of the developed photographic material with the receptor material proceeded at 30° C. during 1 minute.

The residual silver coverages in the unexposed areas of the photographic material expressed in g/m2 silver nitrate are given hereinafter in a Table referring to the sulphides used. The obtained data relate to non-rinsed and rinsed photographic microfilm materials.

Rinsing proceeded in running water for 5 s at 20° C.

TABLE

| Heavy metal sulphide | non-rinsed | rinsed |
|---|---|---|
| | g of $AgNO_3$/m2 | |
| PbS | 0.06 | 0.01 |
| CuS | 0.07 | 0.04 |

TABLE-continued

| Heavy metal sulphide | non-rinsed | rinsed |
|---|---|---|
| | g of $AgNO_3$/m2 | |
| $Bi_2S_3$ | 0.05 | 0.01 |

I claim:

1. A method for processing an exposed photographic silver halide emulsion material which method comprises the steps of:

(A) developing an image-wise exposed silver halide emulsion layer by means of (a) diffusible developing agent in the absence of such an amount of silver halide solvent that would reduce the coverage of developed silver metal (Ag/m2) by more than 20%, using an aqueous alkaline liquid, (B) bringing the emulsion layer side of said developed photographic material while still wet by the liquid from step (A) into contact with a water-absorbing processing layer of a receptor element that contains in an organic hydrophilic colloid binder, a silver halide reducing agent and silver halide compexing agent and in waterpermeable relationship therewith physical development nuclei, (C) maintaining said photographic material and receptor element in contact to allow the transfer of dissolved complexed silver compound into said receptor element until removal of undeveloped silver halide from the exposed silver halide emulsion layer is substantially completed, and (D) separating the photographic material from the receptor element, said element containing said development nuclei at a coverage in the range from 0.05 g/m2 to 2 g/m2, said silver complexing agent at a coverage per m2 corresponding with at least 5 mole % of the molar coverage m2 of silver halide in the photographic material to be processed.

2. Method according to claim 1 wherein the physical development nuclei are colloidal particles of heavy metal sulphides or selenides, by heavy metal being meant a metal with an atomic number of at least 24.

3. Method according to claim 2, wherein the colloidal metal sulphide is silver sulphide.

4. Method according to claim 1, wherein the pH of the aqueous alkaline liquid used in developing step (A) is at least 9.

5. Method according to claim 1, wherein developing step (A) is carried out in the complete absence of silver halide solvent.

6. Method according to claim 2, wherein said physical development nuclei comprises a combination of colloidal silver sulphide with colloidal zinc sulphide.

7. Method according to claim 1, wherein the receptor element is initially dry before contacting the developed still wet photographic material.

8. Method according to claim 1, wherein the receptor element is a receptor web or sheet.

9. Method according to claim 1, wherein step (A) is carried out with an activator liquid initially free from any developing agent, such agent being present already in the exposed photographic material before development.

10. Method according to claim 1, wherein the hydrophilic colloid binder of the receptor element is gelatin.

11. Method according to claim 1, wherein the silver complexing agent is a watersoluble thiosulphate.

12. Method according to claim 11, wherein sodium thiosulphate is applied at a coverage from 0.50 g to 5 g per m2.

13. Method according to claim 1, wherein such silver halide reducing agent, is present in the receptor element in a coverage in the range from 0.2 g/m2 to 3 g/m2.

14. Method according to claim 13, wherein the receptor element contains as silver halide reducing agent a silver halide developing agent of the diffusion resistant type.

15. Method according to claim 1, wherein the photographic material contains a diffusible dye image-forming compound adapted for carrying out a dye diffusion transfer process and the receptor element contains also a mordanting agent for fixing said dye image-forming compound transferred by image-wise diffusion from the developed photographic silver halide material.

16. Method according to claim 15, wherein said dye image-forming compound is an anionic dye and the mordanting agent is a cationic polymeric mordanting agent.

17. Method according to claim 15, wherein the mordanting agent is present in the receptor element at a coverage in the range from 0.1 to 5 g per m2.

* * * * *